US005683088A

United States Patent [19]

Rose

[11] Patent Number: 5,683,088

[45] Date of Patent: Nov. 4, 1997

[54] BOARD GAME APPARATUS AND METHOD

[76] Inventor: Randall D. Rose, P.O. Box 723, 429 Redwood Dr., Seymour, Ind. 47274

[21] Appl. No.: 713,967

[22] Filed: Sep. 12, 1996

[51] Int. Cl.[6] ..... A63F 3/00

[52] U.S. Cl. ..... 273/243; 273/146

[58] Field of Search ..... 273/243, 248, 273/249, 250–254, 256, 274, 146

[56] References Cited

U.S. PATENT DOCUMENTS

| | | | |
|---|---|---|---|
| D. 121,919 | 8/1940 | Dorfman | D21/22 |
| D. 181,770 | 12/1957 | Willis | D21/26 |
| D. 219,035 | 10/1970 | Keast | D21/26 |
| 1,490,153 | 4/1924 | Wischhusen et al. | 273/249 |
| 2,787,469 | 4/1957 | Glover | 273/248 |
| 3,427,027 | 2/1969 | Kenyon | 273/243 |
| 3,536,328 | 10/1970 | Finerty | 273/243 |
| 4,012,046 | 3/1977 | Liket | 273/243 |
| 4,346,897 | 8/1982 | Sisak | 273/271 |
| 4,350,339 | 9/1982 | Imbert | 273/148 A |
| 4,362,302 | 12/1982 | Gardner | 273/236 |
| 4,955,619 | 9/1990 | Christman | 273/273 |

*Primary Examiner*—Benjamin H. Layno
*Attorney, Agent, or Firm*—Woodard, Emhardt, Naughton, Moriarty & McNett

[57] ABSTRACT

A game board apparatus and method of playing the game according to the present invention includes a game board arranged with four player areas. The four player areas are arranged in a virtually identical manner and each is marked for one of the four suits of a conventional deck of playing cards. Each player area includes four blocks with each block being partitioned into two game spaces which are separated by a ladder. The cards marked in the eight game spaces are for the two through nine of that player's suit. Above the ladders in each player's area are four squares marked for the jack, queen, king, and ace of that player's suit. An initial target value is assigned for the play of the game and a conventional deck of playing cards with a joker-like wild card mixed in is shuffled and placed on the game board. A conventional die in combination with a color-coded die is used by each player during their turn. The conventional die determines the number of game spaces to be moved by a common game token, used by all players. The color-coded die determines the number of cards to be drawn by that player on his turn. Once all the cards of the deck are drawn, a round has ended and the players generate their own score based upon the cards which they are holding at the time the round ends. The objective is to reach a score which equals the target amount.

20 Claims, 2 Drawing Sheets

BOARD GAME APPARATUS AND METHOD

BACKGROUND OF THE INVENTION

The present invention relates in general to board games, card games, and games of strategy for two, three, or four players. More specifically, the present invention relates to a combination board game and card game with a moving target number which determines the winner of the game.

There exists a wide variety of games which are typically referred to as "board games" due to the use of a game board with specific defined areas and markings, and often color coding. These board games are usually arranged for play by two, three, or four players, with one player positioned along each side of the game board.

Often board games incorporate the use of game cards, such as the "chance" and "community chest" cards of the well-known MONOPOLY™ game. Other games use conventional playing cards and there are patented games with designated areas which are marked like or for conventional playing cards.

One design feature of board games is the type or nature of paths which must be followed in order to play the game. Quite often, there is a single defined path which must be traversed by each player, moving in turn. In games such as MONOPOLY™, the path may be traversed several times during the play of the game. In certain games, when the game pieces representing each player happen to land on the same game square, the rules of the game typically dictate what can or must occur at that point.

In certain games, the object is to travel the defined path and be the first player to reach the end of the path in order to win the game. In other games, there may be multiple paths or courses upon which either one or multiple tokens, corresponding to and controlled by each player, are moved.

In certain games, the outcome is determined or controlled primarily by the luck of the players in rolling dice and/or drawing cards. Often there is very little strategy to the game because there are either no decisions to be made or it is clear what decisions should be made as the game pieces are moved and playing cards are drawn. In order to introduce strategy decisions into board games, some games have been made overly complicated and are not suitable for younger players. Still other games have tried to incorporate a greater challenge from the standpoint of strategy decisions, but the play can quickly become somewhat one-sided and the ultimate winner is known long before the game mercifully ends.

Over the years, a variety of board games have been patented and the following listing is believed to provide a representative sampling of these earlier patents:

| U.S. PAT. NO. | PATENTEE | ISSUE DATE |
|---|---|---|
| 4,955,619 | Christman | Sep. 11, 1990 |
| 3,427,027 | Kenyon | Feb. 11, 1969 |
| 4,350,339 | Imbert | Sep. 21, 1982 |
| 4,362,302 | Gardner | Dec. 7, 1982 |
| 4,346,897 | Sisak | Aug. 31, 1982 |
| 4,012,046 | Liket | Mar. 15, 1977 |
| 3,536,328 | Finerty | Oct. 27, 1970 |
| Des. 219,035 | Keast | Oct. 27, 1970 |
| Des. 181,770 | Willis | Dec. 17, 1957 |
| Des. 121,919 | Dorfman | Aug. 13, 1940 |

As should be clear from a review of the listed patents and from the comments which have been made, numerous game features, playing options, board designs and rules have been invented over the years. In some games there is a movable playing token assigned to each player, while in other games each player has several movable playing tokens. In some games there is a single defined path, while in other games there are a plurality of path options. Certain games incorporate playing cards and other games do not. With all of these variables and the number of game options which are available, it is easy to see why there are so many different board games, both patented and unpatented. Since some games enjoy commercial success and others do not, the key question is what features determine or dictate which games will be successful and which ones will not. It is felt that a game will be successful if it provides a clever combination of luck and strategy with a few key rules mixed in which can dramatically influence the outcome. A game which has some simplicity in the use or movement of playing pieces and tokens should be successful, at least for younger players. It is also felt that a game will be commercially successful, or at least have the requisite composition to be commercially successful, if the outcome of the game can be placed in doubt until the very end. One game feature or characteristic which would add to the interest level of the game is to mix in a variety of steps and secondary decisions.

The present invention provides an interesting combination of unique game board features, a deck of conventional playing cards, player markers, and a single movable token where the number of spaces moved is determined by the roll of a die. There are secondary decisions to be made and a moving target number whose value can be changed by a variety of maneuvers made by each player. There are individual ladders which are provided for each player as part of that player's side of the game board and ladder markers are moved up the ladder as a secondary aspect of the primary movement of the movable token. At the top of the ladder, the player has one of five options to select from as far as handling certain of his cards or the held cards of one of the other players. The variety of features and the specific set of rules of the present invention create a challenging and interesting game which is fun for two to four players over a wide range of ages.

SUMMARY OF THE INVENTION

A game board apparatus for use in playing a game for two to four players according to one embodiment of the present invention comprises a game board having four sides, each of which is arranged with a plurality of game blocks, each of the four sides being marked with a different one of the four suits of a deck of conventional playing cards, each of the plurality of game blocks being arranged with two game spaces which are separated by a ladder, a plurality of conventional playing cards to be placed on the game board, a single token to be placed on a starting square of the game board and used by all players, and a plurality of ladder markers provided to each player and initially placed on each ladder.

According to another embodiment of the present invention, a method of playing a board game for the described game board is disclosed and comprises the steps of providing a game board with four player areas and a plurality of game spaces and ladders corresponding to each player area, providing a plurality of playing cards, providing a move-determining die, providing a card-determining die, providing a game token, providing a plurality of ladder markers for each player, establishing a target value, determining the order of play and having the first player roll the dice, drawing and processing, one at a time, each of the cards determined by the roll of the card-determining die, moving the token on the game board the number of game spaces determined by the roll of the move-determining die, moving the corresponding ladder marker of the player rolling the dice up one space on that player's ladder which is contiguous to the card space which has the same card number as the card space where the token comes to rest, repeating the foregoing steps with the next player in clockwise rotation rolling the dice, selecting a point during the play of the game to score the cards then held by each player based upon the processing rules of the game, and comparing the score of each player to the target value in order to determine if there is a game winner and who that game winner would be.

One object of the present invention is to provide an improved board game apparatus. A related object of the present invention is to provide an improved method of playing a board game.

Further objects and advantages of the present invention will be apparent from the following description.

DESCRIPTION OF THE PREFERRED EMBODIMENT

Figure 1:
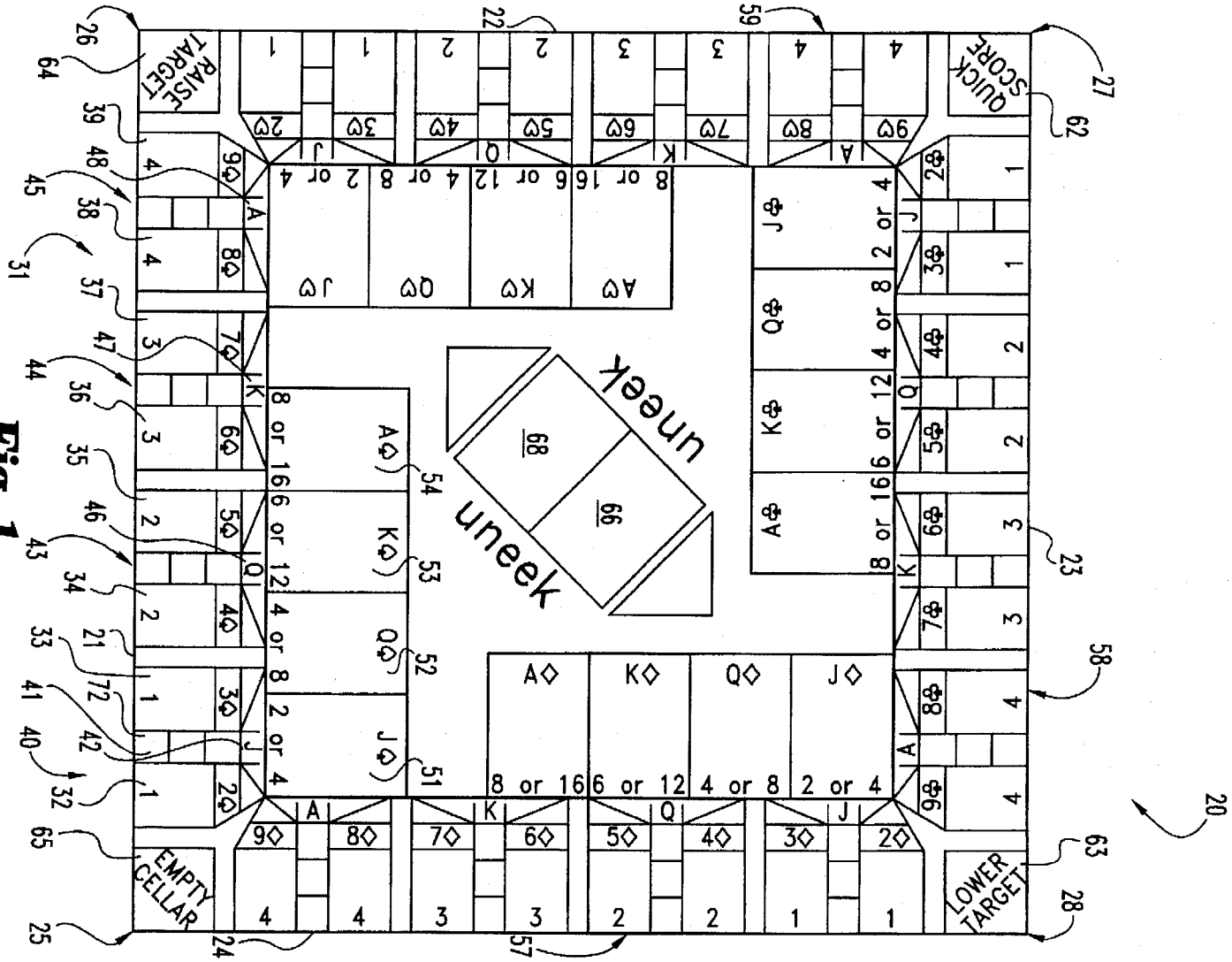
FIG. 1 is a top plan view of a game board according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, the game board 20 of the present invention is illustrated. Board 20 is substantially square with four straight side edges 21–24 which intersect at right angles to create the four corners 25–28. The board game corresponding to board 20 is designed for two, three, or four players and each player assumes a position along one of the four side edges 21–24. Each side of the board is designated and marked as a player area with a different one of the four suits of a deck of conventional playing cards, namely either clubs, diamonds, hearts, or spades. Each side of the board is also arranged with eight spaces which are marked with playing cards 2 through 9 of the corresponding suit for that player sitting on that side of the game board.

Since each of the four sides of the game board 20 and the four player areas are virtually identical to each other, with the exception of the suit differences, side 31 which is designated for spades will be described in detail and it is to be understood that this description is representative of each of the other three sides and player areas which would correspond to the suits of clubs, diamonds, and hearts.

Side 31 includes eight card spaces 32–39 which are correspondingly marked for eight playing cards beginning with the two of spades and continuing in order through the nine of spades. Each pair of adjacent card spaces (32 and 33 as one example) are arranged in a block 40 which includes a three-square or three-rung ladder 41 and a card designation area 42 at the top of the ladder. In block 40, the card designation area 42 is marked for a jack. Blocks 43, 44, and 45 are arranged similar to block 40 as far as corresponding to two playing cards, having a ladder and including a card designation area at the top of the ladder. In block 43, the game spaces are marked for the four of spades and for the five of spades as indicated in spaces 34 and 35. The card designation area 46 is marked for a queen. In block 44, the six of spades and seven of spades are designated in spaces 36 and 37 and area 47 is marked for a king. In block 45, the eight of spades and nine of spades are designated in spaces 38 and 39 and area 48 is marked for an ace.

Located above card spaces 32–36 and extending toward the center portion of the game board 20, there are four rectangular areas 51–54. Area 51 is marked with the jack of spades. Area 52 is marked with the queen of spades. Area 53 is marked with the king of spades. Area 54 is marked with the ace of spades.

In the playing of the game, point values are associated with or assigned to each card which is held by a player based upon the point values marked in the corresponding areas as indicated in FIG. 1. These point values are marked in a contrasting color along the bottom edge of the inside area of spaces 32–39 and in the rectangular areas 51–54. A one point value is assigned to the two and to the three. A two point value is given to the four and to the five. A three point value is given to the six and to the seven. A four point value is given to the eight and to the nine. With regard to the jack through ace as marked in areas 51–54, respectively, one of two point values is possible for each. The point value for the jack is either two or four. For the queen, the point value is either four or eight. For the king, the point value is either six or twelve. For the ace, the point value is either eight or sixteen. As explained, the foregoing description and layout of designated areas for side 31 are virtually identical for each of the other three sides of the game board. Side 57 is marked with the suit of diamonds. Side 58 is marked with the suit of clubs. Side 59 is marked with the suit of hearts. The arrangement of putting spades and clubs on opposite sides (i.e., the black suits) is deliberate so that a partners arrangement can be made a part of the game as one option. The red suits, diamonds and hearts, are located opposite to each other in furtherance of the partners option.

While each of the four sides 31, 57, 58, and 59 has a similar arrangement, albeit with different suits, there are six other areas which should be considered as common areas to the four sides and common areas to each of the players. It will be noted from the FIG. 1 illustration that there are four corner squares 62–65. Square 62 is marked for "quick score" and the significance of this and the other three squares will be explained hereinafter. Square 63 is marked "lower target" while square 64 is marked "raise target". Square 65 is marked for "empty cellar". Square 66 is used for the deck 67 of playing cards (see FIG. 2) and square 68 is used for the playing card discards.

Figure 2:
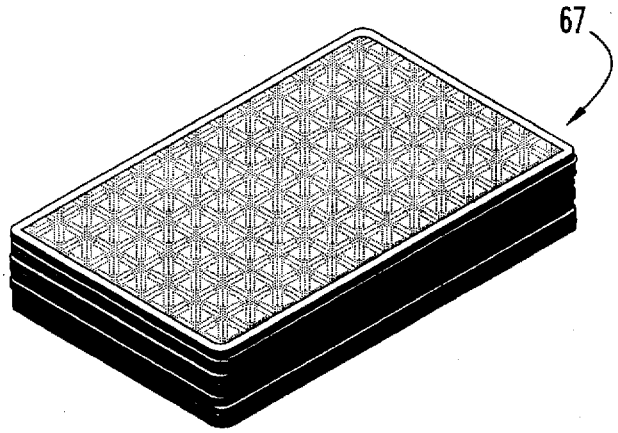
FIG. 2 is a perspective view of a deck of conventional playing cards which comprise a portion of the present invention.
Figure 3:
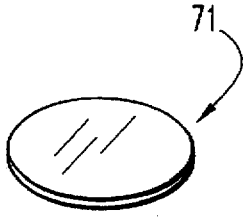
FIG. 3 is a perspective view of one ladder marker comprising a portion of the present invention.

Referring to FIGS. 2–7, other items which comprise various parts or portions of the game which is associated with game board 20 are illustrated. In FIG. 2, a deck 67 of conventional playing cards (52 total) is illustrated. A marker 71 is illustrated in FIG. 3 and there are a total of four markers given to each player and used by each player in conjunction with the four ladders on each side of the game board. The markers 71 are placed in the first section 72 of each ladder 41 and are moved up the ladder, one section or one rung at a time, as dictated by the rules of the game.

Figure 4:
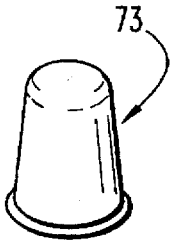
FIG. 4 is a movable token comprising a portion of the present invention.
Figure 5:
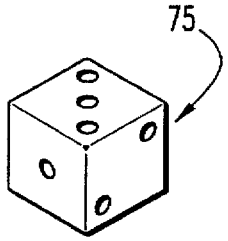
FIG. 5 is a perspective view of a conventional die which is used in the play of the game of the present invention.

In FIG. 4, a token is illustrated and this token represents the movable game piece which is used by all of the players. In contrast to other games where each player has their own movable game piece to indicate where they are on the board, the present invention uses only one movable game piece (token 73) which is moved in turn by each player. After one player moves the token 73 to the appropriate game space, the next player in clockwise order around the game board will move the game token 73 based upon the roll of die 75 beginning the movement of the token from its resting or landing position based upon the prior turn. The token 73 also moves in a clockwise direction around the game board.

As explained, there is one ladder 41 positioned in each block and a separate marker 71 is placed in the first section of each ladder. The ladders do not constitute actual game spaces of the game board which are used and counted in moving the token 73. The actual game spaces of the game board are limited to the eight card spaces 32–39 on each side 31, 57–59, and the four corner squares 62–65. The number of spaces which the token 73 is moved on each turn is determined or indicated by the roll of the FIG. 5 die 75. Die 75 is a conventional die with a different number marked on each face by means of one through six dots.

Figure 6:
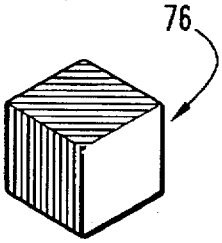
FIG. 6 is a perspective view of a color-coded die which is used in the play of the game of the present invention.

On each player's turn, die 75 is rolled along with a non-conventional die 76 (see FIG. 6). Die 76 is non-conventional in that it does not have numbers (i.e., dots) on each side or face, but instead each face has a particular color. Three of the six sides are white, two sides are blue, and the sixth and final side is red. While the roll of die 75 determines the number of game spaces moved by token 73, the roll of die 76 determines the number of cards which are drawn from deck 67 by the player rolling the dice. A white side up on die 76 means that one card is to be drawn by the player rolling the dice on that player's scheduled turn. A blue side up means that two cards are to be drawn and a red side up means that three cards are to be drawn.

Although the dice are rolled together, the player must draw the card(s) first and deal with the card(s) before moving token 73. If more than one card is to be drawn on any one turn by the player, then the first card drawn must either be kept or discarded before the second card is drawn, and this procedure is repeated if a third card is to be drawn.

Figure 7:
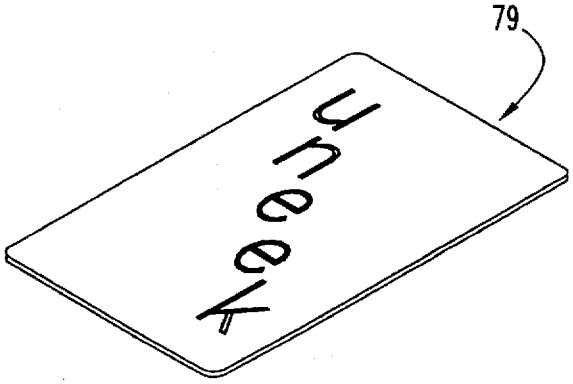
FIG. 7 is a perspective view of a joker-type wild card which is used in the play of the game of the present invention.

Referring to FIG. 7, a joker-like wild card 79 is illustrated and the markings on this card corresponding to the name of the game which has been selected for the present invention. Accordingly, the FIG. 7 playing card 79 is marked with the UNEEK trademark which corresponds to the name of the game. The backside design of card 79 is identical to the backside design of the other fifty-two cards of deck 67. In the playing of the game, the joker-like wild card 79 is shuffled into deck 67. In fact, the joker could actually be used as the UNEEK™ card. Although an actual UNEEK™ card is provided as part of the game apparatus, if this card is lost or damaged, one of the jokers from a conventional deck of playing cards could be used instead.

Now that the apparatus and component parts of the game of the present invention have been described, the specific use of the apparatus and component parts will be described in conjunction of the rules of the game and the playing options and strategies.

The object of the game of the present invention is for a player to get his game total equal to the moving target amount. The moving target amount changes during the play of the game and a player's game total is established and changed by drawing, playing, and eliminating playing cards which are drawn from deck 67 with the joker-like wild card 79 inserted into the deck. At any time during or at the end of a round, whenever a player's game total is equal to the moving target amount, assuming only one player has the corresponding game total, the game is over. As has been described, the "equipment" for the game includes the game board 20, two dice 75 and 76 (numbers and colors), a token 73, a regular deck 67 of fifty-two playing cards, a custom UNEEK™ card 79, and sixteen ladder markers 71. A pen and paper will be needed for the one player selected as the score keeper.

To begin the play of the game, the game board is placed flat on a table and each player selects a card suit and accordingly sits on that side of the game board 20. The word "target" is written in the upper lefthand corner of the score sheet and the starting amount of "50" is placed below it. Each player's name is then listed across the top of the score sheet.

A marker 71 is placed in the bottom block (the end closest to the player) of each of the four ladders 41 on each side where a player is sitting. The joker-like wild card 79 is added to the fifty-two card deck 67 and the deck is then shuffled and placed face down in either of the two squares 66 or 68 (for draw and discard) located in the center of the game board 20. The one token 73 is shared by all players and represents each player on their travels around the game board. To start, token 73 is placed on corner square 65 which is marked "empty cellar".

The moving target amount which starts out at fifty points is raised ten points each time the token 73 lands on the corner square 64 marked "raise target". Each time the token lands on the corner square 63 marked "lower target" the target value is lowered by ten points. Also, the player having the wild card 79 has the option to raise or lower the target amount by ten points when it is that player's turn to play and before moving the token 73. The target amount will never go below zero points nor above one hundred points. If the target amount is at zero points and the token 73 lands on the "lower target" corner square 63, there is no change to the target amount. Likewise, if the target amount is at one hundred points and the token 73 lands on the "raise target" corner square 64, there is no change to the target amount. Likewise, the target amount will never be moved below zero nor above one hundred by means of the wild card 79.

Play of the game continues until one player gets his score equal to the target amount or until the target amount is moved to an amount which is equal to the score of any one player. Only one player can equal the target amount and actually win the game. If two or more players have score amounts equal to the target amount, a situation which will likely happen only infrequently, then play continues for all of the players, until only one player has a score amount equal to the target amount.

Each player has the "scoring option" to have all of his points either added to or subtracted from his existing game total, each time scores are recorded. This scoring option is permitted as long as the adding does not put the player's game total above one hundred and so long as the subtracting does not put the player's total below zero. If a player can only add or subtract to stay within the zero to one hundred range, he must do whichever one is permitted and would not have a "scoring option" in this situation. If a player cannot add or subtract all of his points without putting his game total above one hundred or below zero, which will only happen in a rare situation, then the player does not score any of his points.

The play of the game begins by each player rolling the number die 75 to see who starts the game. The player rolling the highest die number moves first. When counting the number of spaces to be moved, the token 73 skips over the ladders and moves from space to space, including the four corner squares 62–65. Upon completion of a player's turn, the token remains on the landed space and the next player begins from that point. The beginning player rolls dice 75 and 76 together. The color die 76 indicates the number of cards that player is to draw from the deck. The color white indicates one card to be drawn, blue indicates two cards to be drawn, and red indicates that three cards shall be drawn from the deck. The number die 75 indicates the number of spaces the token 73 is to be moved. A player must always draw the card or cards as the first step or event on his turn, before moving the token. Also, when a player is to draw more than one card, he must draw and "file" (i.e., either discard or keep) each card as it is drawn, before that player draws the next card as part of the same turn.

The card suit which is denoted in card spaces 32–39 and in areas 51–54 along each side of the game board is referred to as "the suit" for the player who is positioned or seated on that side of the game board 20. A player must keep all cards of his suit when drawn, unless he already has the same card of a different suit. Whenever a player draws a card of his suit, but already has the same card of a different suit and the card is face-up, then this gives that player what is called a "choosey". This player has the option to either accept or decline points (an instant score) for this particular card, at its regular point value. The drawn card is discarded whether or not the player elects to score from it. If points are accepted, the points are either added or subtracted at once to the player's score. If a card of the player's suit is drawn and the player has a card of that same rank, and it is NOT face-up, then the drawn card does not create a "choosey" and it is simply discarded.

A player may never keep a ten card of any suit which is not his suit. However, the player who draws a ten card of another player's suit is able to score points for that other player. It is the scoring option of the player who drew the ten card as to whether the points are to be added to or subtracted from the score of the player that corresponds to the suit of the drawn ten card. If a player draws a ten card of a suit other than his own, and there is no player having that suit, the ten card which was drawn is simply discarded. A player drawing a ten card of a suit other than his own, for which there is a player having that suit, shall discard the ten card afer the points have been scored from it. Except for the ten card, each player has the choice of keeping all other cards of another suit, providing the player does not already have a card of the same rank.

All cards kept by a player are either placed into his "attic" or his "cellar". The rectangular areas 51–54 above a player's ladders 41 consisting of his suit's jack through ace is his "attic". Although described for the player whose suit is spades, each player has a corresponding attic location. The area below the ladders 41 and actually off of the board beneath the card spaces 32–39, and the two corner squares 64 and 65 is the player's "cellar", as indicated for the player whose suit is spades. Each side of the game board has a corresponding cellar location for each of the other players. The cards held in the cellar should be positioned beneath the corresponding card as denoted for card spaces 32–39. A player who keeps a card does not score any points when he draws that card and retains it. In fact, the player may lose that card before he is ever able to score points for that card. For easy reference, the point value(s) assigned to each card is marked on the game board in the space, block, or area corresponding to each card. All cards in the attic and all cards in the cellar are to be placed face up initially. As will be described hereinafter, other game strategies may result in one or more of the cards being turned face down. Only one card of each rank may be kept by each player in that player's attic and cellar. For example, if a player draws a jack and already has a jack in the attic, the drawn jack must be discarded.

When a player draws his own suit's ten card, it is placed under the left corner 64 in his cellar. It then has the potential to double the point value of only the cards which are in that player's attic, when that player scores. A player must retain the ten card of his suit until all the cards in the deck (in square 66 or 68) have been drawn or until the player is able to land the game token 73 on the "empty cellar" square 65. Cards in a player's cellar never receive a double point value, in other words cards two through nine are limited to the point value assigned to the corresponding spaces 32–39. The wild card 79 when drawn may be used instantly to either raise or lower the target value by ten points. The player drawing the wild card 79 instructs the score keeper of his decision and, if it is used, it is then discarded. Alternatively, the wild card 79 may be kept for use at a later time. The wild card is kept under the righthand corner 65 of the cellar location for that player. When the wild card 79 is used to change the target value, the player electing to do so must do so on his turn and before that player moves token 73. If the wild card is held, it will be lost if the player lands the token on the "empty cellar" square 65. The wild card is also lost and unable to be used when the player who draws the last card from the deck completes his turn.

Whenever a player moves (as part of his turn) the token 73 onto a space next to another player's ladder 41, the moving player then moves his marker 71 up one step or one rung of the matching ladder on his side of the board. For example, if a player's suit is spades and on his move the token 73 lands on the seven of hearts space (i.e., space 37 on side 59), then that player who is in control of the move moves the marker 71 up one step on ladder 41 which is next to the seven of spades space. Likewise, if the token 73 lands next to a ladder on his own side, then that player moves the corresponding marker one step up on that ladder. There are actually three steps to each ladder or three rungs. The end of the ladder is reached when the corresponding marker is moved into the card designation area 42. The options which occur at this point in the play are explained hereinafter.

If the token 73 lands on the corner square 65 which is marked "empty cellar", then that player who is in control of movement of the token, loses and must discard all cards positioned in his cellar. If the token 73 lands on the corner square 62 which is marked "quick score", then the player in control of and moving the token 73 to that square scores all points he has showing at that time whether located in the attic or in the cellar. This player keeps all of the cards which are scored and may score on them again.

Play of the game continues until all cards of deck 67, including the wild card 79, have been drawn and either held by the players or discarded. This completes a "round" and at the end of each round, each player totals his points, based upon the cards which are held. A round is over when the player who draws the last card from the draw block completes his turn. The point total of each player is recorded and play continues until a player's total is equal to the moving target value.

Once the scores of each player have all been posted at the end of each round, the scorekeeper should announce the game totals of each player and the present moving target value. All of the cards are then collected, including the wild card 79, and shuffled and then returned face down to either square 66 or square 68. Neither the token 73 nor any of the ladder markers 71 are moved or reset due to the end of a round.

There is a "reward" for a player who draws the last card from the deck 67 and is supposed to draw more cards based on the roll of die 76. When there are not enough cards left in deck 67 for that player to complete his draw, he scores one point immediately before moving the token 73 for one card which he does not receive, and two points for two cards which he does not receive.

The following is a list of ways to score points and the corresponding point values:

a.) END OF ROUND—The scoring of point values for the two through nine and for the jack through ace are listed on the board in the corresponding areas. A player having the ten card of his suit receives the "doubled score" of those cards stored in the attic, which is the higher of the two point values listed.

(During a round)

b.) QUICK SCORE—The player scores the total of all cards held by that player when the token lands on the corner square 62 marked "quick score".

c.) DRAW OTHER SUIT'S TEN—A player who draws the ten of another player's suit has the control to either add or subtract (using the scoring option) ten points instantly to the score of that other player whose suit corresponds to the suit of the ten which was drawn.

d.) MISSING CARD REWARD—One point is given instantly to the player who is supposed to draw additional cards from the deck 67 when those cards are not available. One point is assigned for one card not drawn, and two points for two cards not drawn.

e.) CHOOSEY—A player drawing a card of his suit who already has that same rank of another suit face-up may either instantly score the value of that card or may elect not to score any points on that card.

With regard to the four ladders 41 assigned to each player, each ladder gives a player various opportunities for making plays on the cards of all players, including his own. The play options are to pass, steal, suspend, revive, or eliminate a card which a player does or does not want to have points scored from. Depending on the scoring situations at the time, a player may accept or decline his chance to make a play. In some instances there may be more than one play he can make, however, he is only allowed to make one so he must then choose from all available options. Also, a player may climb a ladder and find that there is no available play to be made. Regardless of whether a play is or is not made, the ladder marker 71 goes back down to the bottom of the ladder.

When a player climbs up a ladder (all three steps), and is then able to make a play, he can only make a play on a card that corresponds to the side of the block the token 73 is on. For example, when the token 73 lands on any four card space around the game board such as space 34 of block 43, and this causes the player to climb his queen ladder, he may make a play on either a queen card or on a four card. If the token 73 had landed on any five card space around the game board such as space 35, then a play could have been made on either a queen card or on a five card. A player who climbs a ladder may only make a play on a two through nine or jack through ace card and never on a ten card nor on the wild card 79.

The following is a list which describes the five types of plays which may be made once a player reaches the top of a ladder:

a.) PASS—A player having the card (which is face-up) of another player's suit may "pass" the card to that player, as long as the receiving player does not already have a card of that rank. As a strategy point, a player passes his card when he does not want points from it (should he score) and/or to give the other player points (should that player score.

b.) STEAL—A player may "steal" a card (which is face-up) of his suit from another player, as long as he does not already have a card of that rank. A player steals his card when he wants points from it (should he score) and/or to keep the other player from getting points (should that player score).

c.) SUSPEND—A player may "suspend" any card which he has or any card of another player which he does not want points scored from (should the player having it score). When a card gets suspended, it is turned face down and then has no point value, though it may be revived.

d.) REVIVE—A player may "revive" any card which he has or any card of another player which is suspended which he wants points scored from (should the player having it score). When a card gets revived, it is then turned face up and is restored to its regular point value, though it may be suspended again.

e.) ELIMINATE—A player may "eliminate" a card in his attic or cellar which is either face-up or face-down which he does not want points scored from (should he score). When a card is eliminated, it is placed into the discard block. A player may choose to eliminate rather than risk retaining a card in case the target value changes.

In the event four players would like to play partners, the game board 20 is arranged in such a way as to permit this modification. For partners play, the team names of "red" and "black" are to be used and written next to the word "target"on the score sheet. The "red" team positions its two players on the sides of the game board which correspond to the card suits of hearts and diamonds. The two players comprising the "black" team position themselves on the opposite sides of the game board which correspond to the suits of spades and clubs. Although a team shares the same game total, each player still has his own suit, the same as in individual play. At the end of a round, each pair of players, red and black, total their points together and then must decide how they want to score their team's combined total of points using the described scoring option. Since partners share the same game total, games for partners play may last somewhat longer, though a partnership game may be more challenging as compared to individual play.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A board game apparatus comprising:

a game board having four sides, each of which is arranged with a plurality of game blocks, each of said four sides being marked with a different one of the four suits of a deck of conventional playing cards, each of said plurality of game blocks being arranged with two game spaces which are separated by a ladder;

a plurality of conventional playing cards to be placed on said game board;

a single token to be placed on a starting square of the game board and to be used by all players;

a plurality of ladder markers provided to each player, the number of ladder markers equal to the number of ladders on said game board, and one ladder marker initially placed on each ladder; and move-determining means for deciding on the number of game spaces for the token to be moved by each player on that player's turn.

2. The board game of claim 1 which further includes as additional game spaces four corner squares.

3. The board game of claim 2 wherein the game board includes an attic area for each player.

4. The board game of claim 3 wherein said attic areas include blocks marked with the jack through ace of the corresponding suit for that side of the game board.

5. The board game of claim 4 wherein said plurality of conventional playing cards includes a conventional fifty-two-card deck.

6. The board game of claim 5 wherein there are three steps to be moved as part of moving up a corresponding ladder.

7. The board game of claim 6 wherein the top of each ladder includes a card marking corresponding, in order, to a jack through the ace.

8. The board game of claim 1 wherein the game board includes an attic area for each player.

9. The board game of claim 8 wherein said attic areas include blocks marked with the jack through ace of the corresponding suit for that side of the game board.

10. The board game of claim 1 wherein there are three steps to be moved as part of moving up a corresponding ladder.

11. The board game of claim 10 wherein the top of each ladder includes a card marking corresponding, in order, to a jack through the ace of the corresponding suit for that side of the game board.

12. The board game of claim 1 wherein said attic areas include blocks marked with the jack through ace of the corresponding suit for that side of the game board.

13. The board game of claim 1 which further includes card-determining means for determining the number of cards to be drawn from said plurality of conventional playing cards by each player on that player's turn.

14. The board game of claim 1 which further includes a joker-like wild card to be shuffled into said plurality of conventional playing cards.

15. A board game apparatus comprising:

a game board having four sides, each of which is arranged with a plurality of game blocks, each of said four sides being marked with a different one of the four suits of a deck of conventional playing cards, each of said plurality of game blocks being arranged with two game spaces which are separated by a ladder;

a plurality of conventional playing cards to be placed on said game board;

a player token to be placed on a starting square of the game board and to be moved during play of the game;

a plurality of ladder markers provided to each player, the number of ladder markers equal to the number of ladders on said game board, and one ladder marker initially placed on each ladder; and move-determining means for deciding on the number of game spaces for the token to be moved by each player on that player's turn.

16. A method of playing a board game with a plurality of players comprising the following steps: (a) providing a four-sided game board, each side is arranged with a plurality of game blocks and forming player areas on each side of said game board, said game board including a plurality of game spaces and a plurality of ladders corresponding to each player area each game space having indicia representing a playing card from a conventional deck of playing cards wherein game spaces on each side of the game board represent different playing cards;

(b) providing a plurality of conventional playing cards;

(c) providing a move-determining die;

(d) providing a card-determining die;

(e) providing a game token;

(f) providing a plurality of ladder markers for each player, the number of ladder markers equal to the number of ladders on said game board and one ladder marker initially placed one each ladder;

(g) establishing a target value;

(h) determining the order of play and having the first player roll the dice;

(i) drawing and processing, one at a time, each of the cards determined by the roll of the card-determining die;

(j) moving the token on the game board the number of game spaces determined by the roll of the move-determining die;

(k) moving the corresponding ladder marker of the player rolling the dice up one space on that player's ladder which is contiguous to the game space which has the same card indicia as the game space where the token comes to rest in step (j);

(l) repeating steps (h) through (k);

(m) selecting a point during the play of the game to score the cards then held by each player based upon the processing of step (i); and (n) comparing the score of each player to the target value in order to determine whether or not there is a winner of the game and if so, which player is the winner.

17. The method of claim 16 which further includes the steps of:

(o) arranging each of the four player areas with a dedicated playing card suit which becomes that player's suit; and (p) providing an attic area for each player, which area is partitioned into four spaces which are marked respectively with the jack, queen, king, and ace cards of that player's suit.

18. The method of claim 17 which further includes the step of:

(q) arranging the game board with four corner squares, one of which is used to raise the target value when the game token lands thereon and one of which is used to lower the target value when the game token lands thereon.

19. The method of claim 18 which includes the step of:

(r) providing a joker-like wild card and shuffling said wild card into said plurality of playing cards.

20. The method of claim 19 which further includes the step of:

(s) evaluating between a plurality of different playing options by each player whose ladder marker reaches the top of the ladder.

* * * * *